United States Patent [19]

Van Berne

[11] Patent Number: 5,044,513

[45] Date of Patent: Sep. 3, 1991

[54] HOLDER PROVIDED WITH A LOCKABLE LID

[75] Inventor: Joost Van Berne, Breda, Netherlands

[73] Assignee: Curver Rubbermaid b.v., Breda, Netherlands

[21] Appl. No.: 524,472

[22] Filed: May 17, 1990

[30] Foreign Application Priority Data

May 18, 1989 [NL] Netherlands ..... 8901236

[51] Int. Cl.[5] ..... B65D 45/00

[52] U.S. Cl. ..... 220/318; 220/330; 220/333; 220/91; 220/94 R; 220/96

[58] Field of Search ..... 220/318, 322, 330, 331, 220/333, 91, 94 R, 96

[56] References Cited

U.S. PATENT DOCUMENTS

| | | | |
|---|---|---|---|
| 615,478 | 12/1898 | Davenport | 220/318 |
| 1,299,267 | 4/1919 | Tiers | 220/318 X |
| 2,879,916 | 3/1959 | Hoffman et al. | 220/96 |
| 4,351,448 | 9/1982 | Ingersoll et al. | 220/318 |
| 4,476,994 | 10/1984 | Hope et al. | 220/318 |
| 4,592,482 | 6/1986 | Seager | 220/318 |

FOREIGN PATENT DOCUMENTS 170260 9/1978 Netherlands .

*Primary Examiner*—Stephen Marcus
*Assistant Examiner*—Stephen Cronin
*Attorney, Agent, or Firm*—Cushman, Darby & Cushman

[57] ABSTRACT

The invention relates to a holder provided with a lockable lid and a carrying handle connected with the holder, the ends of which carrying handle are attached to the holder wall, the ends of the carrying handle sticking eccentrically in openings of rotating disks attached to the holder wall, the hand grip part of the carrying handle being positioned in a groove in the lid in a first position of the disks, while in a second position of the disks the carrying handle is clear of the lid.

4 Claims, 4 Drawing Sheets

HOLDER PROVIDED WITH A LOCKABLE LID

BACKGROUND OF THE INVENTION

1. Field of the Invention

The invention relates to a holder provided with a lockable lid and a carrying handle connected with the holder, the ends of the carrying handle being attached to the holder wall.

2. Description of the Prior Art

Such a holder is known from; NL-C-170260. This holder, which is used as a so-called cool box, is provided with a resilient carrying handle, the ends of which, made in the form of pivots, protrude through the holder wall into the holder and can be stuck into recesses in the part of the lid that is sunk into the holder, so that the lid is locked onto the holder. The lid can be removed rather simply by, using one hand, pulling one of the arms of the carrying handle so far aside that the pivot at one side is taken out of the recess in the lid, after which the lid can be lifted at that side, using the other hand. The holder is closed by pressing the lid with some force onto the holder until the pivots slip into the recesses.

As said, the lid can be unlocked rather simply, which makes this lid locking system unsuitable for holders in which poisonous or combustible waste or old medicines are stored temporarily.

People are increasingly aware that this kind of waste, produced in virtually every household, should be stored and taken away separately from other domestic waste. This environmentally very noxious waste is taken to separate waste containers or collected at fixed times by the public authorities.

The temporary storage in a holder of this waste in the house makes it imperative for the lid to be locked onto the holder in such a way that children cannot unlock the lid and so come in contact with the dangerous waste.

SUMMARY OF THE INVENTION

The objective of the invention therefore is to provide a holder for dangerous waste that can be locked with a lid, the lid being locked onto the holder in such a way that children up to a certain age cannot unlock it.

According to the invention this is achieved in that the ends of the carrying handle stick eccentrically in openings of rotating disks attached to the holder wall and in that in a first position of the disks the hand grip part of the carrying handle is positioned in a groove in the lid, while in a second position of the disks the carrying handle is clear of the lid. In the first position the lid is locked onto the holder and in the second position the lid can be removed. For further optimization of the locking, the rotating disks can be provided with two pins, between which the arms of the carrying handle are situated in the first position of the disks, the carrying handle being detachable from the pins against an opposing spring tension. By depressing one of the pins for instance at each of the disks, the respective disk can be turned so that the attachment point of the carrying handle in the disks moves from the first to the second position, thereby unlocking the lid. It is also possible to build in the spring force direction in the carrying handle so that the carrying handle can be moved out of the space between the pins, after which the disks can be turned. The pins can also be made in the lid, at those sides of the lid where the arms of the carrying handle are located. The arms of the carrying handle are between these pins when the lid is locked. The lid can be unlocked in the same way as described above.

In another embodiment the rotating disks are provided with sections that exert spring tension towards the holder wall, with space between those sections in which the arms of the carrying handle are positioned. By depressing one of these resilient sections at each disk and then turning the disks, the lid is unlocked.

The said embodiments of the lid locking system on the holder make it impossible for children up to a certain age to unlock the lid by themselves.

BRIEF DESCRIPTION OF THE DRAWING

Other characteristics and advantages will become clear from the following description, in which reference is made to the accompanying drawings. In these:

FIGS. 3 and 4 are represented on a larger scale.

DETAILED DESCRIPTION OF THE PRESENTLY PREFERRED EXEMPLARY EMBODIMENTS

Figure 1A:
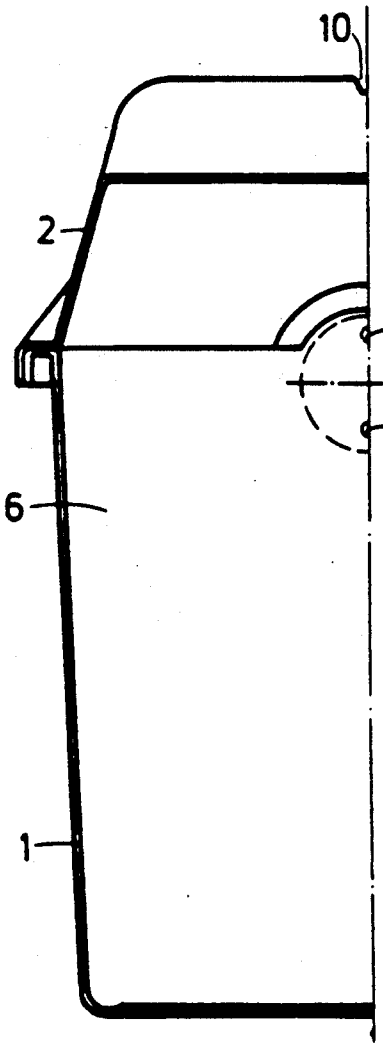
FIG. 1A is a cross section of a holder with lid seen from one of the short side walls.

In the figures, 1 indicates the holder and 2 the lid. By 3 and 4 are indicated rotating disks, section 5 of which protrudes from outside (see fig ,s 3 and 4) through the short side walls 6 of the holder and which are rotatably fixed on the inside thereof with a retaining ring and a pin. It is also possible to provide the holder with stud ends at the places where the disks 3 and 4 come, onto which the disks 3 and 4 are slid and on which they are secured by the carrying handle, in which way the need of making openings through the holder wall is avoided. By 7 is indicated the carrying handle, the ends 8 of which stick into openings 9 of the disks 3 and 4, which openings 9 are positioned eccentrically relative to the center of rotation 5.

Figure 2A:
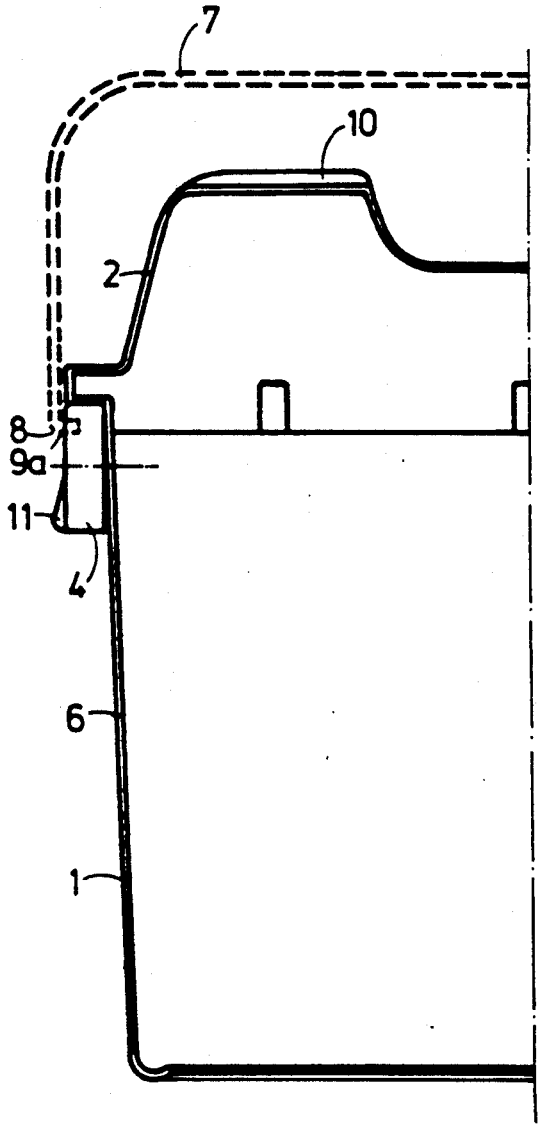
FIG. 2A is a cross section of the holder with lid according to FIG. 1, seen from one of the long side walls.
Figure 2B:
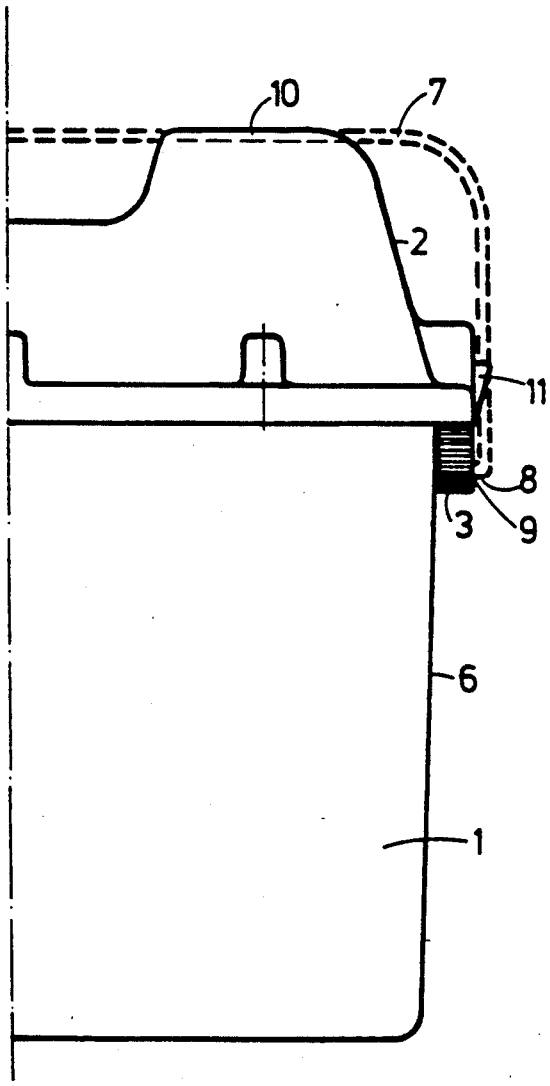
FIG. 2B is a view of the holder with lid according to FIG. 1, seen from one of the long side walls.

FIG. 2A shows that the lid 2 is placed on the holder 1 and that the attachment points 9 of the ends of the carrying handle 7 are in the second or top position. The carrying handle 7 (see FIG. 2A) is then in the top position relative to the holder and can be moved freely across the lid 2 to one of the lower side walls of the holder 1. The lid 2 can now be freely removed from the holder 1 in order to fill the latter with waste or empty it. When the lid 2 has been put back on the holder 1 the carrying handle is swivelled back above the lid and next the disks 3 and 4 are turned so that the attachment points 9 of the disks, in which the ends 8 of the carrying handle 7 stick, move down until they are in the first or bottom position, the horizontal part of the carrying handle 7 falling into a groove 10 of the lid 2. The lid is now locked relative to the holder.

A further improvement of the locking is obtained by providing the disks 3 (4) with parts 11 and 12 that spring towards the holder wall 6, with sufficient room between these springing parts to hold the arm of the carrying handle.

Figure 1B:
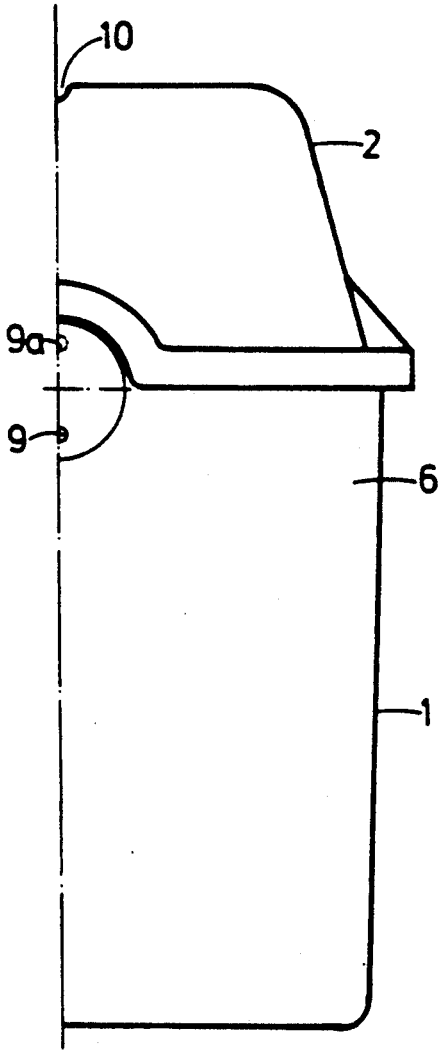
FIG. 1B is a view of the same holder with lid seen from one of the short side walls.
Figure 3:
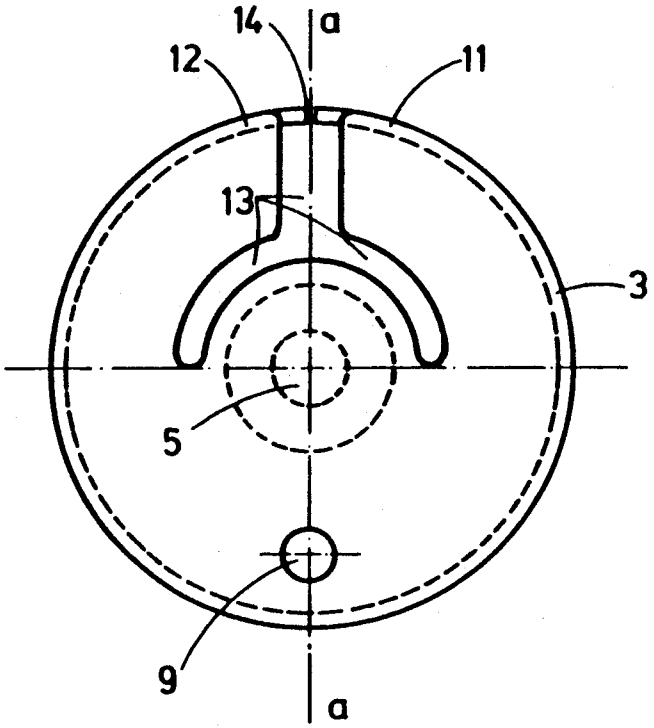
FIG. 3 is a view of one of the rotating disks seen from one of the short side walls.
Figure 4:
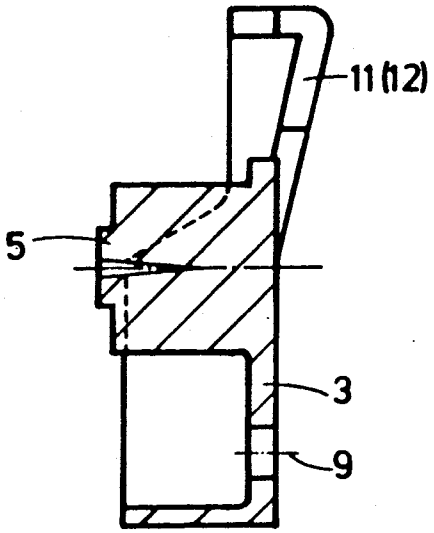
FIG. 4 is a cross section of the rotating disk along line a—a in FIG. 3.

In FIGS. 3 and 4 such a version of the disks is represented. The springing parts 11 and 12 are partially separated from each other by an open groove 13 and 14. The springing parts 11 and 12 are bent away from the holder wall, as shown in the cross section in FIG. 4. In this way it is achieved that the arm of the carrying handle falls into the vertical part of the groove 13 when the lid 2 is locked. The carrying handle 7 is then secured at both short sides of the holder as well as in the groove 10 of the lid 2. The lid 2 can be opened by depressing one of the springing parts of both disks 3 and 4 so far that the disks can be turned, causing the attachment points 9 of the ends 8 of the carrying handle 7 to move upward to position 9*a* (see FIGS. 1A and 1B). The carrying handle 7 is then clear (FIG. 2A) of the lid, so that the lid 2 can be removed. In locking the lid 2 onto the holder 1 again, the reverse takes place.

Figure 5:
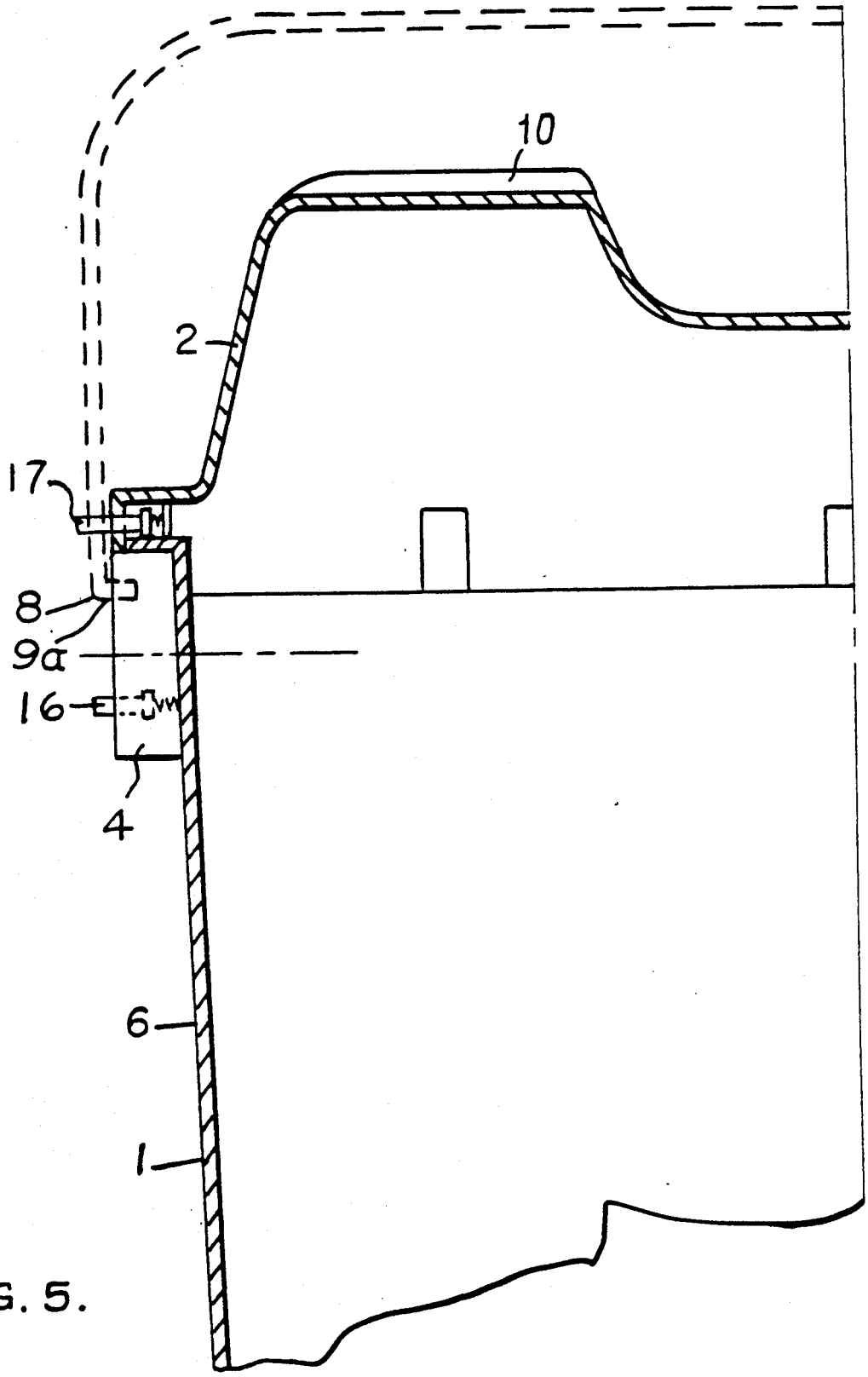
FIG. 5 is a cross sectional view showing the pins that may be used to lock the lid to holder 1. For clarity.

In the framework of the inventive idea, other locking systems are conceivable. It is possible for instance to provide the disks 3,4, the holder wall 6 or the lid 2 with pins, as depicted in FIG. 5 by reference numerals 16 and 17, that form a slot corresponding to the grooves 13 and 14, which pins can be pushed away against an opposing spring tension so that the carrying handle can be swivelled. Further, it is possible not to have exact coincidence between the two positions in which the lid is locked and unlocked, respectively, and the top and the bottom position, respectively, of the disks. In principle, many positions are suitable for this, provided that the form of the handle and the groove 10 are correspondingly adapted. It is also possible to provide more than one handle, each of which can be attached to the holder in a manner as described above. More specifically, pin 16 represents a pin provided in rotating disk 4. Pin 17 represents a pin provided with lid 2. Of course, each of pins 16 and 17 has a mate on the side of the holder 1 180° from the pins pictured.

I claim:

1. A holder provided with a lockable lid and a carrying handle connected with the holder, the carrying handle having ends attached to a holder wall, wherein the ends of the carrying handle stick eccentrically in openings of rotating disks attached to the holder wall and wherein in a first position of the disks a hand grip part of the carrying handle is positioned in a groove in the lid, while in a second position of the disks, the carrying handle is clear of the lid.

2. A holder according to claim 1, wherein the rotating disks are provided with two pins, between which arms of the carrying handle are situated in the first position of the disks, the carrying handle being detachable from the pins against opposing spring tension.

3. A holder according to claim 1, wherein the lid is provided with two pins, at those sides of the lid where arms of the carrying handle are, between which pins the arms of the carrying handle are situated in the first position of the disks, the carrying handle being detachable from the pins against an opposing spring tension.

4. A holder according to claim 1, wherein the rotating disks are provided with two sections that exert spring tension towards the holder wall, in between which arms of the carrying handle are situated in the first position of the disks.

* * * * *